US006344838B1

(12) United States Patent
Jaeggi

(10) Patent No.: US 6,344,838 B1
(45) Date of Patent: Feb. 5, 2002

(54) CONTROL DEVICE FOR A LIQUID CRYSTAL DISPLAY CELL

(75) Inventor: Hugo Jaeggi, Fontaines (CH)

(73) Assignee: EM Microelectronic-Marlin SA, Marlin (CH)

( * ) Notice: Subject to any disclaimer, the term of this patent is extended or adjusted under 35 U.S.C. 154(b) by 0 days.

(21) Appl. No.: 09/277,947

(22) Filed: Mar. 29, 1999

(30) Foreign Application Priority Data

Apr. 6, 1998 (CH) ..... 0812/98

(51) Int. Cl.[7] ..... G09G 3/36
(52) U.S. Cl. ..... 345/51; 345/52
(58) Field of Search ..... 349/38; 438/459; 340/784, 765; 368/10; 345/100, 51, 52, 87

(56) References Cited

U.S. PATENT DOCUMENTS 4,466,742 A * 8/1984 Lemelson ..... 368/10
4,999,619 A * 3/1991 Te Velde ..... 340/784
5,132,677 A * 7/1992 Nicholas ..... 340/784
5,218,352 A * 6/1993 Endoh et al. ..... 340/765
5,412,261 A 5/1995 Whitten
5,508,715 A * 4/1996 Kuroki ..... 345/51
5,701,166 A * 12/1997 Fedorovish et al. ..... 349/38
5,773,355 A * 6/1998 Inoue et al. ..... 438/459
5,831,588 A * 11/1998 Hotto ..... 345/100

FOREIGN PATENT DOCUMENTS

EP 536739 4/1993
FR 2712109 5/1995

* cited by examiner

*Primary Examiner*—Steven Saras
*Assistant Examiner*—Christopher J. Maier
(74) *Attorney, Agent, or Firm*—Sughrue Mion, PLLC

(57) ABSTRACT

The present invention concerns a control device (21) for a liquid crystal display cell (1) including electrodes (1.1*a;* 1.1*b;* 1.1*c*) forming segments and/or symbols. This device includes control means (33*a;* 33*b;* 33*c*) for providing control signals to said electrodes; and a matrix network of connection paths (45; 47; 49; 50) whose columns (49; 50) are connected to said control means, and whose lines (45; 47) are connected to receive address signals and data signals representative of said control signals. This device further includes switching means (52) arranged at each of the intersections of said network, each of said switching means being arranged so as to be able to be switched permanently into the conducting state or the non conducting state, in accordance with a circuit layout predetermined as a function of said cell.

3 Claims, 5 Drawing Sheets

CONTROL DEVICE FOR A LIQUID CRYSTAL DISPLAY CELL

SUMMARY OF THE INVENTION

The present invention concerns devices for controlling a liquid crystal cell and, ore precisely, such devices for controlling liquid crystal display cells intended to display segments and/or symbols.

In the present description, such a cell will be designated "LCD" (Liquid Crystal Display).

Such LCD cells are commonly used in numerous applications, in particular pocket calculators, wristwatches and measuring instruments.

French Patent No. 2,712,109 discloses a conventional LCD cell. FIGS. 1 and 2 of the present description show respectively views of the front face of a first substrate 1 and the back face of a second substrate 2 of the LCD cell disclosed in the aforementioned Patent.

The substrate or plate 1 includes first electrodes (in particular those designated by the references 1.1 and 1.1*a* to 1.1*c*) which form the symbols such as "ON", "OFF" and "AUTO", and second electrodes (in particular those designated by the references 1.2) which form segments grouped in the shape of an "8" to form the figure display. By way of example, electrode 1.1*a* forms the "OFF" symbol, and electrodes 1.1*b* and 1.1*c* form two segments in a same group of segments in the shape of an "8".

The substrate or plate 2 includes third electrodes (in particular those designated by the references 2.1) arranged facing the first electrodes of plate 1, and fourth electrodes (in particular those designated by the references 2.2) able to be arranged facing the second electrodes of plate 1, as described hereinafter.

Plates 1 and 2 are separated from each other by a sealing frame 3 which forms, with the two plates 1 and 2, a cell within which a layer of liquid crystal 4 is enclosed.

Plate 1 also includes a plurality of contact pads (in particular those designated by the references 1.3 and 1.5) arranged on the exterior of frame 3, as well as conductive paths (in particular those designated by the reference 1.4) connected to the first and second electrodes. By way of example, contact pad 1.3 is connected to the three electrodes 1.1*a* to 1.1*c* by path 1.4. The contact pads can be connected to an electric voltage source, and said connection paths are arranged so as to provide voltage across said electrodes of plates 1 and 2, as is described in more detail hereinafter.

One will briefly recall how the layer of liquid crystals 4 of LCD cell 1 is activated or deactivated.

An electric voltage is applied across one of the first (or second) electrodes of plate 1 and the electrode of plate 2 which is arranged facing said electrode of plate 1. As a result, an electric field is generated between these two electrodes, and this field acts on the component formed by the liquid crystals present between such electrodes, so as to change the transmission or reflection characteristics of the light through this component.

One usually speaks of the activation of the LCD cell in the event that light is blocked, and the corresponding symbol and/or segment is displayed, and of the deactivation of said cell in the event that the light is reflected, and said symbol and/or segment is extinguished (positive contrast mode).

Generally, an LCD cell such as described in relation to FIGS. 1 and 2, is connected to a conventional control device or driving circuit arranged to provide electric control voltages (or control signals) able to cause activation or deactivation of the LCD cell.

Such a control device commonly supplies control signals which are multiplexed, with the object of reducing the number of connections between the control device and the LCD cell.

In order to achieve multiplexing of these control signals, and with reference again to FIGS. 1 and 2, each of the contact pads of plate 1 is connected to three of the first and second electrodes of this plate. By way of example, contact pad 1.3 which is connected to electrodes 1.1*a* to 1.1*c*, can receive in sequence three respective signals from the control device. Typically, electrode 1.1*a* receives a first signal ("1" or "0") from the control device during the first phase of a multiplexing cycle, respectively to display or extinguish the "OFF" symbol formed by electrode 1.1*a*. Likewise, electrode 1.1*b* receives a second signal ("1" or "0") during the second phase of the cycle, respectively to display or extinguish the segment formed by electrode 1.1*b*, and electrode 1.1*c* receives a third signal ("1" or "0") during the third phase of this cycle, respectively to display or extinguish the segment formed by electrode 1.1*c*.

A control device of this type is disclosed in Japanese Patent Application No. 9171376.

FIG. 3 of the present description shows the device 10 disclosed in the aforementioned Japanese Patent Application. This device is arranged to control the activation and deactivation of pixels of an LCD cell 12. Device 10 includes several control means 14 connected to substrate 16 by a plurality of connection lines 18. These connection lines provide to means 14 data originating from a memory 20, and representing the allocation of the control of the pixels to be activated.

Let us consider the case in which such a control device is connected to the LCD cell disclosed in relation to FIGS. 1 and 2, to control the activation or deactivation of the LCD cell. Let us suppose for example that one wishes to command the display of the "OFF" symbol, given that the "ON" symbol is initially displayed.

Control device 10 then requires six multiplexing cycles in order to carry out the command to display the "OFF" symbol.

A first cycle is assigned to reading the states ("0" or "1") of the control means of each of the three electrodes connected to contact pad 1.5, in order to know the state of display of the "ON" symbol. The second cycle is assigned to deleting the states which were stored in said means, and read during the first cycle. The third cycle is assigned to writing the "0" state in the control means of the electrode forming the "ON" symbol, to command the extinction of such symbol. The fourth cycle is assigned to reading the states of the control means of each of electrodes 1.1*a* to 1.1*c*. In the expected case in which the "OFF" symbol is not initially displayed, the fourth cycle is followed by fifth and sixth cycles. The fifth cycle is assigned to deleting the "0" state from the control means of electrode 1*a* and the sixth cycle is assigned to writing "1" state in said means, to command the display of the "OFF" symbol.

One drawback of a control device such as that described hereinbefore, lies in the fact that it does not allow the manufacturer to adapt the allocation of the command to an LCD cell, so as to control the display of the desired message simply and rationally. This is all the more of a handicap if the LCD cell is of the same type as that described in relation to FIGS. 1 and 2, i.e. an LCD cell including segments and/or symbols which one wishes to display periodically in applications such as wristwatches, measuring instruments and electronic games.

Moreover, in the event that such control devices are made monolithically in a semi-conductor substrate, new constraints and concerns, linked to the making of integrated structures, such as the complexity, space requirement and cost of such structures, then arise.

SUMMARY OF THE INVENTION

One object of the present invention is to provide a control device for an LCD cell, this device overcoming the difficulties and drawbacks of the aforementioned conventional devices, in particular a device which allows the control of a predetermined LCD cell to be rationalised.

Another object of the present invention is to provide such a device able to be made in a semi-conductor substrate, occupying a minimum surface area.

Another object of the present invention is to provide such a device capable of being made by conventional manufacturing processes in the semi-conductor industry.

Another object of the present invention is to provide such a device satisfying the conventional semi-conductor industry constraints and concerns as to complexity, space requirement and cost.

These objects, in addition to others, are achieved by the control device according to claim 1.

One advantage of the switching means of the control device according to the present invention, is that they are able to be switched in accordance with a circuit layout depending on the LCD cell to be controlled, so as to connect the paths which provide the same signals able to control different electrodes to cause the simultaneous display of segments and/or symbols. In other words, the control device has a configuration which depends on the LCD cell to be controlled, which tends to reduce the duplication of identical data, and which involves use of a smaller storage memory for the addresses and data to be provided to the control means of said device. There is a consequent reduction in the consumption of electrical power.

One advantage of the integrated structure including the control device according to the present invention, is that it is formed of components which can be made during conventional manufacturing processes.

One advantage of such a structure is that it can receive and supply signals compatible with a conventional central processing unit.

BRIEF DESCRIPTION OF THE DRAWINGS

These objects, features and advantages of the present invention, in addition to others, will appear more clearly upon reading the detailed description of two embodiments of the present invention, given solely by way of example, in relation to the annexed drawings, in which.

DETAILED DESCRIPTION OF THE INVENTION

Figure 4:
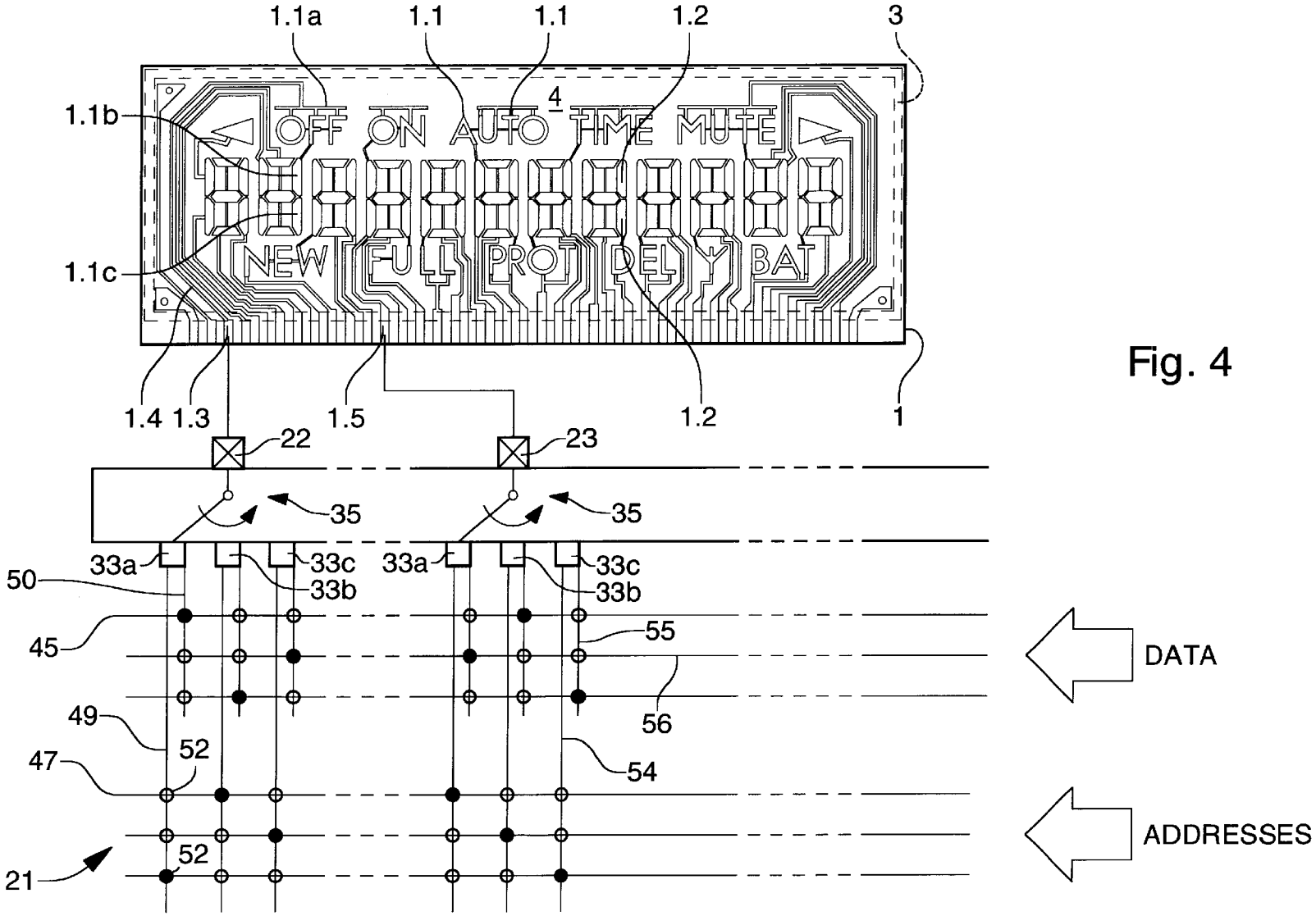
FIG. 4 shows a first embodiment of a control device according to the present invention connected to the LCD cell described in relation to FIGS. 1 and 2.
Figure 5:
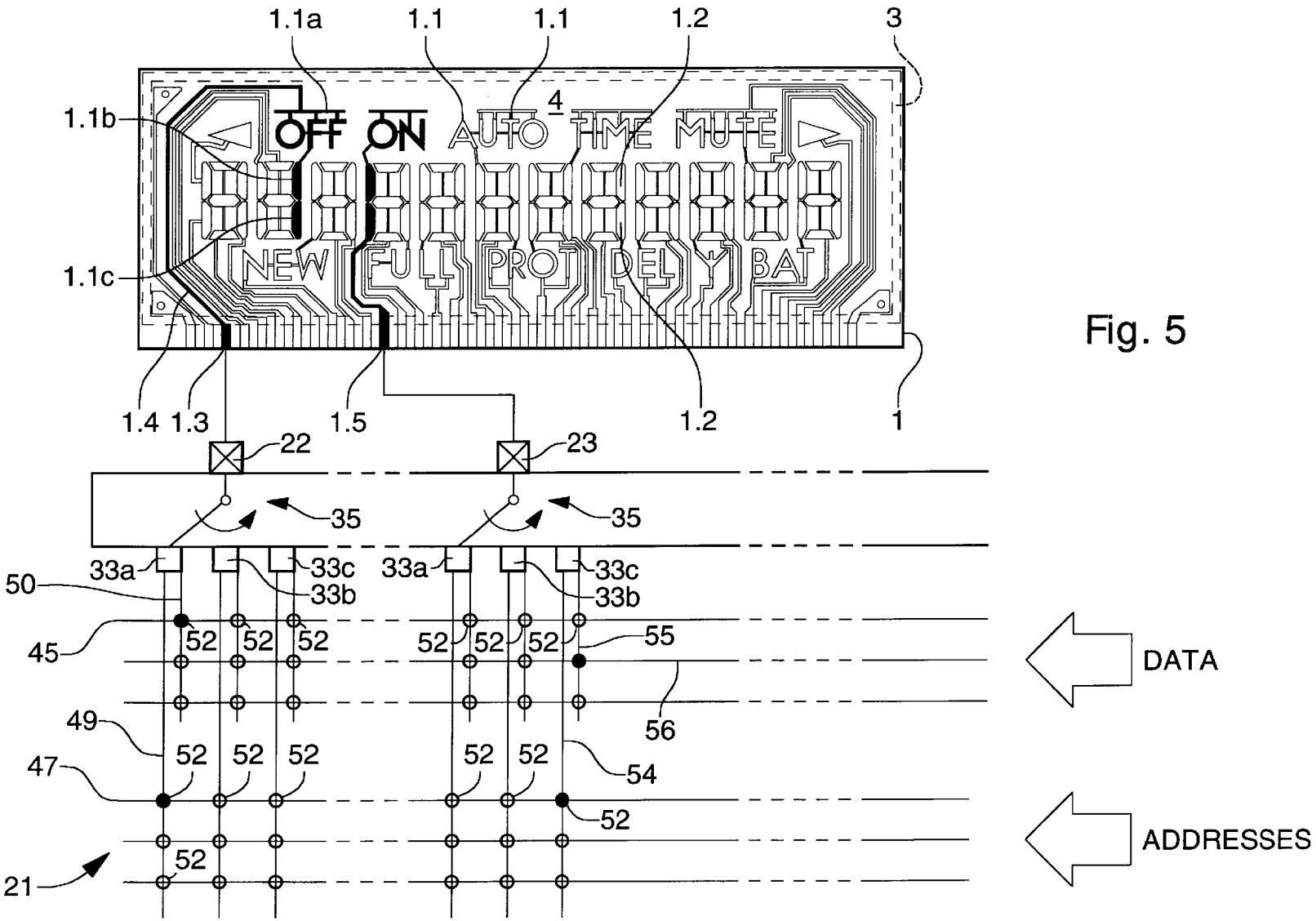
FIG. 5 shows a second embodiment of a control device according to the present invention connected to the LCD cell described in relation to FIGS. 1 and 2.

FIGS. 4 and 5 show two embodiments of the control device according to the present invention which will be designated hereinafter by the reference 21.

Figure 1:
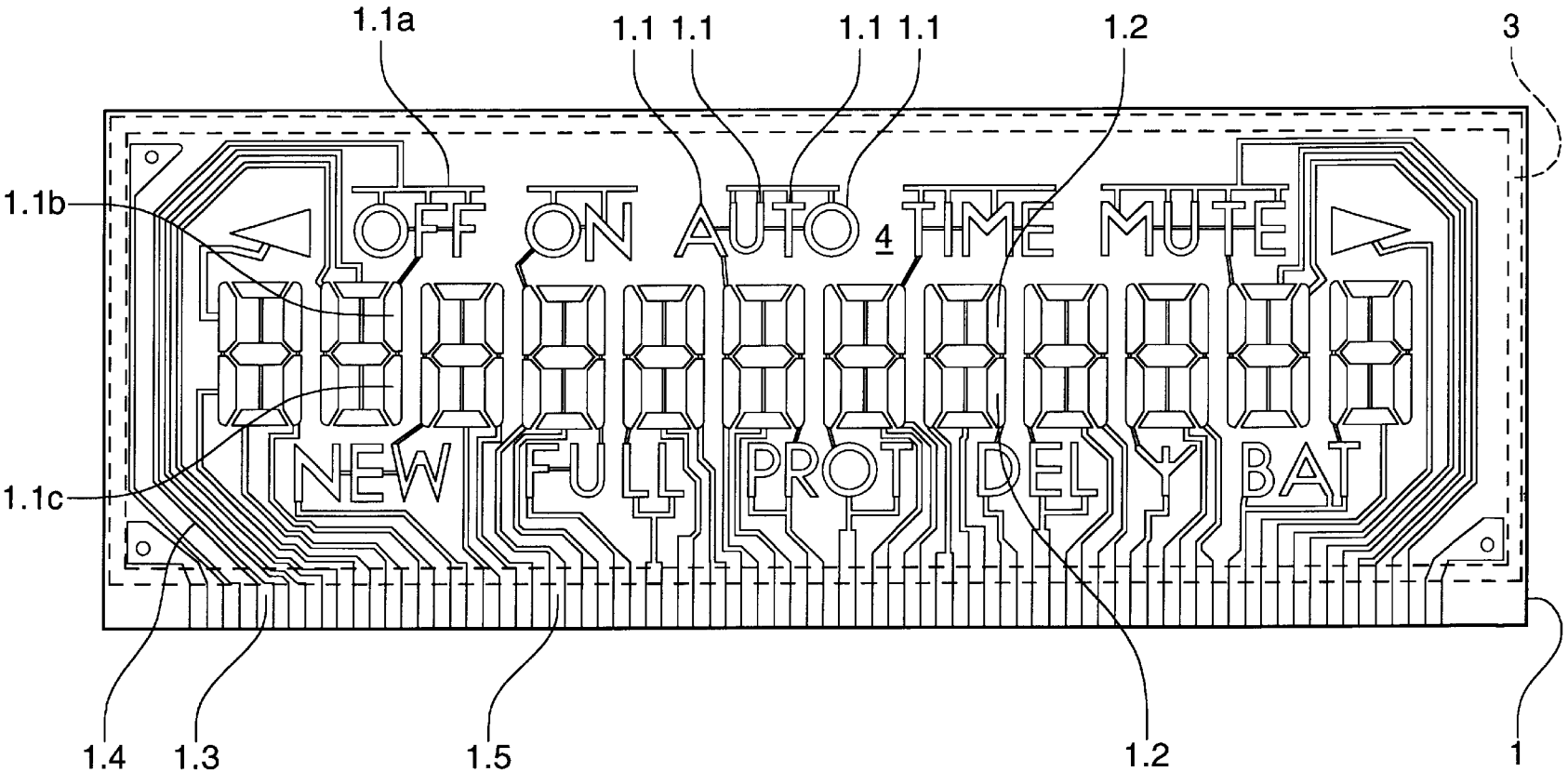
Fig. 1 (PRIOR ART)
FIGS. 1 and 2 which have already been cited, show respectively views of the front face of a first substrate and the back face of a second substrate of a conventional LCD cell.
Figure 2:
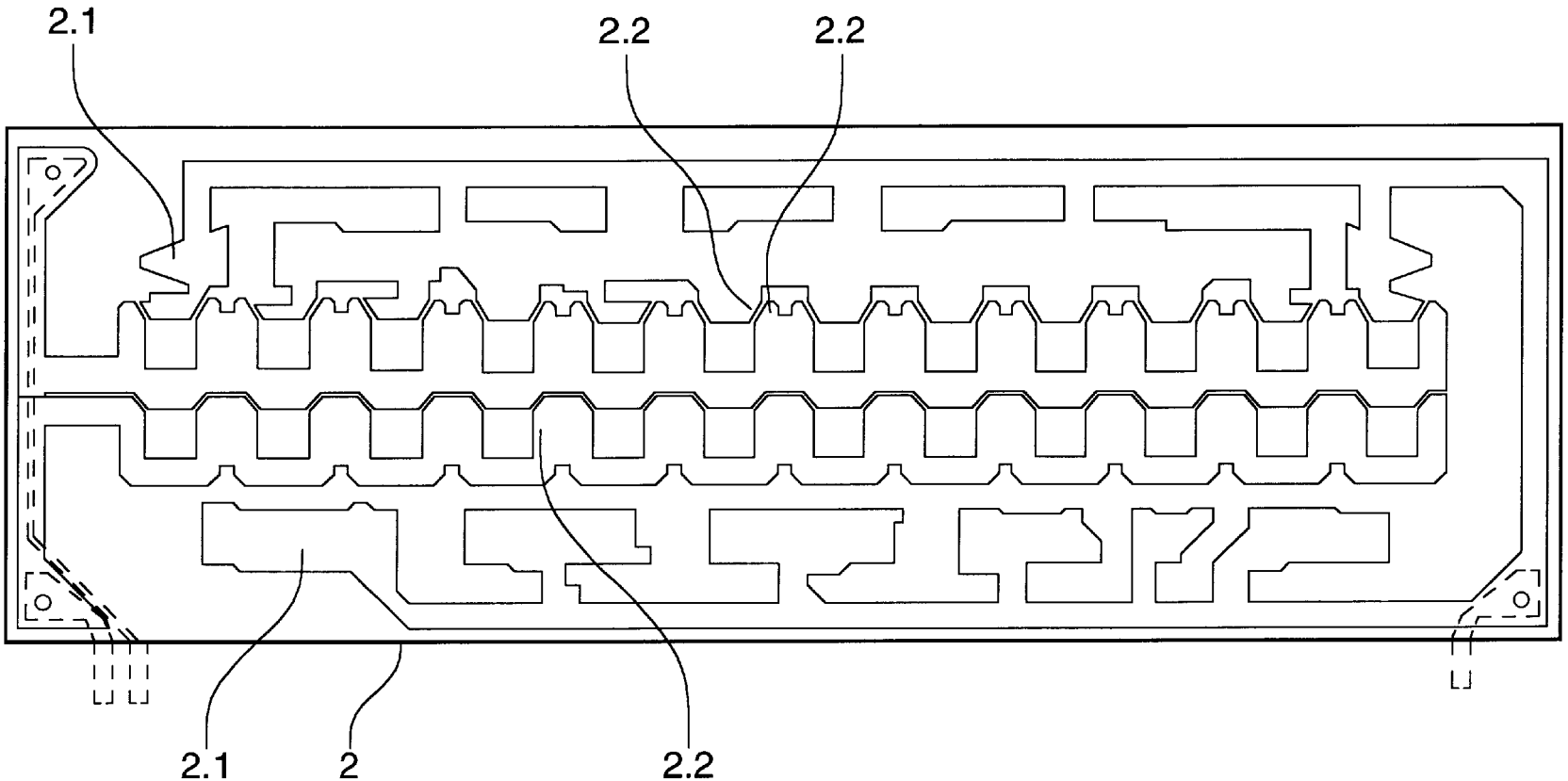
Fig. 2 (PRIOR ART)
Figure 3:
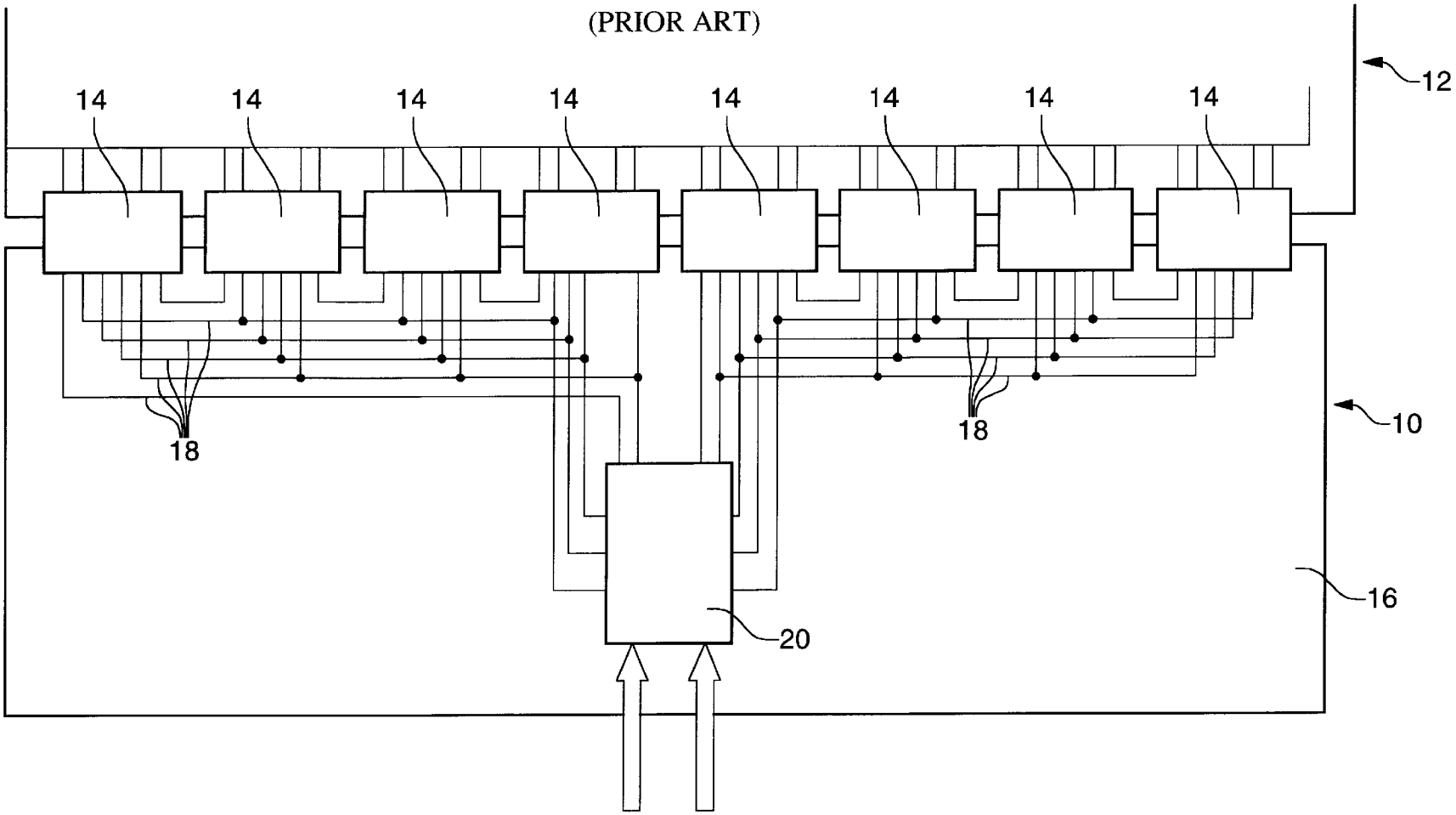
Fig. 3 (PRIOR ART)
FIG. 3 which has already been cited shows a control device connected to a conventional LCD cell.

Control device 21 is intended to control an LCD cell which is represented, solely by way of example, by that described in relation to FIGS. 1 and 2. Thus, the elements of this device 21 which are identical to those described in relation to FIGS. 1 and 2 have been designated by the same numerical references.

Let us consider first the embodiment of control device 21 with reference to FIG. 4.

Control device 21 includes a plurality of terminals connected to the plurality of contact pads 1.3, 1.5 of LCD cell 1. For the sake of clarity, only two of these terminals have been shown in FIG. 4, and are designated by the references 22 and 23.

Control device 21 further includes a plurality of control means (in particular those designated by the references 33*a* to 33*c*), a plurality of multiplexing means (in particular those designated by the reference 35) and a matrix network of connection paths (in particular those designated by the references 45, 47, 49, 50, 52 and 54 to 56).

The control means are arranged to provide signals able to control the display or extinction of the corresponding symbols and/or segments to the first and second electrodes of LCD cell 1.

Preferably, each of the control means is made using a known D latch, i.e. means able to store the "0" or "1" logic state of the control signal to be provided.

Each of the multiplexing means is connected between one of the connection terminals and three of said control means, and arranged to form in sequence an electric connection between said terminal and one of the control means.

By way of example, during a multiplexing cycle including three phases, control means 33*a* to 33*c* which can be connected to terminal 22 provide the respective control signals of electrodes 1.1*a* to 1.1*c*, via multiplexing means 35, connection terminal 22, contact pad 1.3 and conductive path 1.4. Typically, electrode 1.1*a* is controlled by means 33*a* during the first phase of a multiplexing cycle, electrode 1.1*b* is controlled by means 33*b* during the second phase, then electrode 1.1*c* is controlled by means 33*c* during the third phase.

Preferably, each of the multiplexing means is made using a known multiplexer.

The matrix network of connection paths includes lines (in particular those designated by the references 45 and 47) and columns (in particular those designated by the references 49 and 50). Preferably, the connection paths are made depositing metal strips.

The columns of this network are connected to the control means. By way of example, columns 49 and 50 are connected to control means 33*a*.

The lines of this network are connected to a central processing unit (not shown) which provides binary electric signals ("0" or "1") representing on the one hand the selected address of the control means to modify the state of the control signal provided by said means to the electrode to which it is connected during one of the three phases of a multiplexing cycle, and on the other hand, the data of such state. It will be recalled that the "0" state of a control signal of an electrode represents the deactivation of the LCD cell, i.e. the extinction of the symbol and/or segment formed by such electrode, and the "1" state represents the activation of such electrode, i.e. the display of this symbol and/or segment. By way of example, line 45 provides signals containing state data, and line 47 provides signals containing selected addresses.

Control device 21 further includes a plurality of switching means 52 which are arranged at each of the intersections between the lines and the columns of the matrix network.

Each of switching means 52 is arranged so as to be able to be switched permanently into the conducting "ON" state or the non conducting "OFF" state, in accordance with a predetermined circuit layout. The ON or OFF state of each of switching means 52 is represented respectively by a black or white dot. By way of example, switching means 52 between line 45 and column 50 are represented by a black dot, which means that these means are in the ON state. In other words, line 45 is connected to column 50, and control means 33*a* receive data contained in the signals provided by line 45. Also by way of example, switching means 52 between line 47 and column 49 are represented by a white dot, which means that these means are in the OFF state. In other words, line 45 is not connected to column 50, and control means 33*a* do not receive the addresses contained in the signals provided by line 47.

Preferably, each of switching means 52 is made by forming a metallisation at each of the intersections between the lines and the columns of the matrix network, or by not forming such a metallisation.

Those skilled in the art will note that the control means, the matrix network and the switching means of control device 21 can be formed monolithically in a semi-conductor substrate, in accordance with a conventional semi-conductor product manufacturing process. It will be considered, in the present description, that a process of this type is obvious to those skilled in the art, given their knowledge in the field of manufacturing such products. Thus, in the present description, a process of this type, which produces a control device such as that shown in FIG. 4, will not be described.

One advantage of switching means 52 lies in the fact that they can be switched in accordance with a circuit layout depending on the LCD cell 1 to be controlled, so as to connect the paths which provide different electrodes with the same control signals to cause the simultaneous display of segments and/or symbols. In other words, control device 21 has a rationalized configuration as a function of the LCD cell to be controlled, which tends to reduce the duplication of identical data.

Let us consider secondly, the second embodiment of the control device according to the present invention, with reference to FIG. 5. This Figure shows a device according to the present invention which provides the rationalised command of the "OFF" and "ON" symbols of LCD cell 1.

It will be noted that control device 21 shown in FIG. 5 is substantially identical to that shown in FIG. 4. Thus, the elements of this device 21 which are identical to those described in relation to FIGS. 1 and 2 have been designated by the same numerical references.

It will be noted however that the configuration of the circuit layout of said matrix network shown in FIG. 5 is different to that shown in FIG. 4, in order to realise said rationalised command.

Thus, as FIG. 5 shows, switching means 52 arranged at the intersection of line 47 and column 49 are in the ON state, as are those arranged at the intersection of line 47 and column 54, so that means 33*a* able be connected to terminal 22 and means 33*c* able to be connected to terminal 23 can receive the same selected addresses from said processing unit. Conversely, switching means 52 arranged at the intersection of line 45 and column 50 are in the ON state, while those arranged at the intersection of line 45 and column 55 are in the OFF state.

The operation of the control device of FIG. 5 will now be described, in the aforementioned case in which one wishes to command the display of the "OFF" symbol, assuming that the "OFF" and "ON" symbols have to be alternately display by LCD cell 1, and that the "ON" symbol is initially displayed.

During a first multiplexing cycle during the first phase of which means 33*a* provide, via terminal 22, a "0" signal commanding the extinction of the "OFF" symbol, and during the third phase of which means 33*c* provide, via terminal 23, a "1" signal commanding the display of the "ON" symbol, said processing unit provides control device 21, via line 47, with addresses which are selected to correspond to means 33*a* able to command the display of the "OFF" symbol and to means 33*c* able to command the extinction of the "ON" symbol. Such address supply has the effect of authorising the reprogramming of said control means by the state data, in the following manner. At the same time, said processing unit provides, via line 56, state data representing the extinction of the "ON" symbol (i.e. "0") and, via line 45, state data representing the display of the "OFF" symbol (i.e. "1").

Thus, during the first phase of the multiplexing cycle following this reprogramming of said control means, means 33*a* provide, via terminal 22, a "1" signal commanding the display of the "OFF" signal, and during the third phase of this cycle, means 33*c* provide, via terminal 23, a "0" signal commanding the extinction of the "ON" symbol.

In other words, control device 21 only requires two multiplexing cycles to realise command of the display of the "OFF" symbol of LCD cell 1, which makes a rationalised control of this device, with regard to the prior art described hereinbefore.

It goes without saying for those skilled in the art that the control device which has just been described in detail, can undergo various modifications without departing from the scope of the present invention. By way of example, one can make a control device according to the present invention including as many connection terminals as there are symbols and/or segments of the LCD cell to be controlled, each of these terminals being intended to be connected to a single symbol or segment, which achieves multiplexing free control of the LCD cell.

What is claimed is:

1. Control device (21) for a liquid crystal display cell (1) allowing the display of a predetermined message with segments and/or symbols formed by a plurality of electrodes (1.1*a;* 1.1*b;* 1.1*c*) in response to control signals provided by said device, this device including:

a plurality of control means (33*a*; 33*b*; 33*c*) to provide said control signals to said electrodes; and a matrix network of connection paths (45; 47; 49; 50) whose columns (49; 50) are connected to said control means, and whose lines (45; 47) are connected to receive address signals and data signals representative of said control signals, this device being characterised in that it further includes a plurality of switching means (52) arranged at each of the intersections between the lines and the columns of said matrix network, each of said switching means being arranged so as to be permanently switched into the conducting state or the non conducting state in accordance with a circuit layout predetermined as a function of said cell, to allow the simultaneous display of segments and/or symbols, these latter having to be displayed cyclically to provide said predetermined message, wherein said control device further includes multiplexing means arranged so that at least two segments and/or images of the cell are sequentially controlled during a multiplexing cycle.

2. A control device according to claim 1, wherein said control means, said matrix network and the switching means are formed monolithically from a semi-conductor substrate.

3. A control device according to claim 2, wherein said switching means are made by metallisations at the surface of said semi-conductor substrate.

* * * * *

UNITED STATES PATENT AND TRADEMARK OFFICE

CERTIFICATE OF CORRECTION

PATENT NO. : 6,344,838 B1
DATED : February 5, 2002
INVENTOR(S) : Hugo Jaeggi

It is certified that error appears in the above-identified patent and that said Letters Patent is hereby corrected as shown below:

Title page,
Please delete "Item [73] Assignee: EM Microelectronic-Marlin SA, Marlin (CH)"; and please insert -- Item [73] Assignee: EM Microelectronic-Marin SA, Marin (CH) --.

Signed and Sealed this

Seventeenth Day of December, 2002

JAMES E. ROGAN
*Director of the United States Patent and Trademark Office*